US006325660B1

(12) United States Patent
Diaz et al.

(10) Patent No.: US 6,325,660 B1
(45) Date of Patent: Dec. 4, 2001

(54) LOW CROSSTALK COMMUNICATION CONNECTOR

(75) Inventors: Zoila A. Diaz, Robbinsville; Wayne Scott Filus, Lebanon; Michael John Konyak, Clifton, all of NJ (US); Chen-Chieh Lin, Indianapolis, IN (US); Troy Paul Million, Sparta, NJ (US)

(73) Assignee: Avay Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/709,163

(22) Filed: Nov. 10, 2000

(51) Int. Cl.[7] ..... H01R 4/24; H01R 4/26; H01R 11/20

(52) U.S. Cl. ..... 439/418; 439/941

(58) Field of Search ..... 439/418, 460, 439/676, 404, 941, 610, 731

(56) References Cited

U.S. PATENT DOCUMENTS 6,250,951 * 5/2000 Milner et al. ..... 439/460

* cited by examiner

*Primary Examiner*—Brian Sircus
*Assistant Examiner*—Javaid Nasri
(74) *Attorney, Agent, or Firm*—Thomas, Kayden, Horstemeyer & Risley, LLP

(57) ABSTRACT

A connector plug for interconnecting plurality of twisted pairs of wires in a cable has a body portion having a flared recess therein. A flared insert fits within the recess and has a top surface having first and second wire pair guiding channels and a bottom surface having third and fourth wire pair guiding channels extending from a cable entrance end to a contact end of the body portion. The insert has a channel defining cross-tail which is insertable into the end of the cable and the cable is crimped thereto by a crimping ring. A contact bearing contact base is mounted on the contact end of the body portion with the contacts immediately adjacent the end of the insert. Thus, the wires stay twisted from the cable to the contacts.

11 Claims, 9 Drawing Sheets

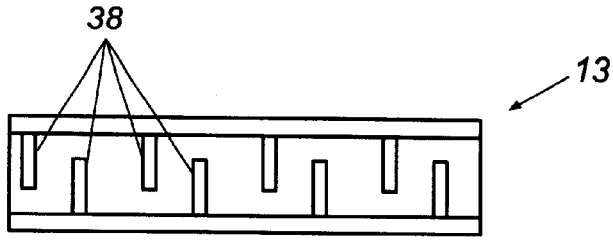
Fig. 8
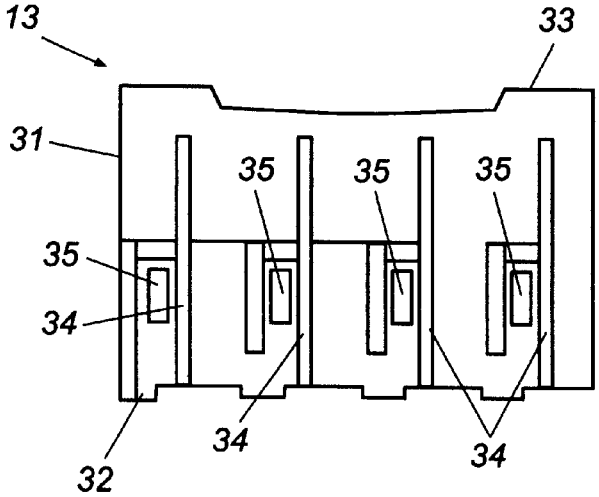
Fig. 7
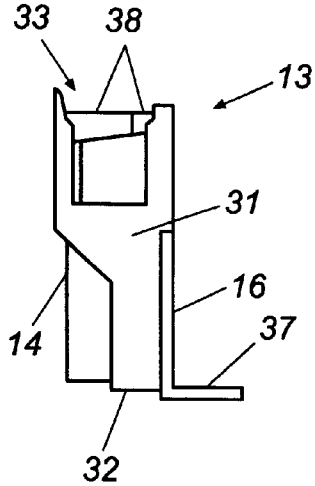
Fig. 9
Fig. 6
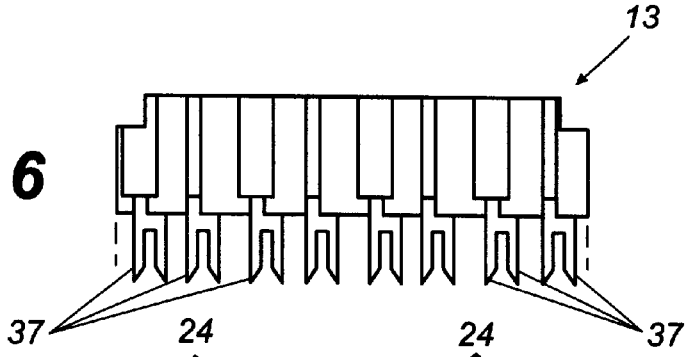
Fig. 5
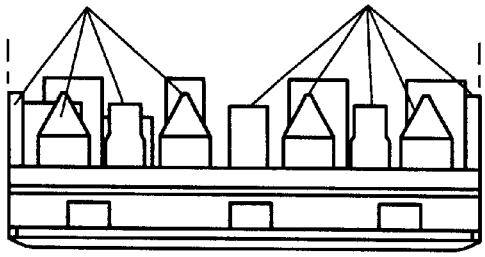

LOW CROSSTALK COMMUNICATION CONNECTOR

RELATED PRIOR ART

The subject matter of this application is related to that of U.S. Pat. No. 5,911,594 of Baker et al., U.S. Pat. No. 5,226,835 of Baker et al., and U.S. Pat. No. 6,250,949 of Lin, the disclosures of which are incorporated herein by reference.

FIELD OF THE INVENTION

This invention relates to electrical communications connectors and, more particularly, to a patch plug having reduced crosstalk between adjacent transmission paths.

BACKGROUND OF THE INVENTION

One type of plug used to terminate cordage (ie., multi-wire cabling) is the 110-type patch plug, manufactured by Avaya Communications of Basking Ridge, N.J. One end of the 110-type patch plug permanently terminates a multi-wire cable, while the other end mates removably to the insulation displacement contacts (IDCs) of a 110-type connecting block, which is also manufactured by Avaya Communications. 110-type patch plugs are often used in voice and data transmission applications. In such transmissions, a balanced signal transmission path is formed by each pair of conductors, called the TIP conductor and the RING conductor. A typical 8-wire cable can therefore support four different voice or data signal transmission paths.

A 110-type patch plug has one or more pairs of contacts (typically 1, 2, 3, or 4 pairs) that form the electrical connections between the conductors of a multi-wire cable and the IDCs of a 110-type connecting block. One end (i.e., the mating end) of each patch-plug contact is a blade that engages a split-beam contact of the 110-type connecting block. The other end (ie., the cable end) of each patch-plug contact has a split-beam contact (e.g., an IDC) that terminates one of the cable conductors. The blades are sequenced in a liner alternating fashion between TIP and RING conductors in order to be aligned with the split-beam contacts of a 110-type connecting block.

One common type of conventional multi-wire cabling used for telecommunications applications has one or more twisted pairs of copper wires, where each twisted pair carries the TIP and RING signals for one balanced transmission path. In order to reduce crosstalk between these transmission paths, a different twist rate is used for each different twisted pair within such cordage. A twist rate may be characterized in terms of the number of times the wires of a twisted pair circle one another over a particular length of cordage, e.g., in terms of revolutions per foot.

Near-end crosstalk (NEXT) refers to unwanted signals induced in one transmission path due to signals that are transmitted over one or more other transmission paths appearing at the end nearest to where the transmitted signals are injected. Near-end crosstalk often occurs when the wires, contacts, and/or other conductors that form the various transmission paths are in close proximity to one another. The twist rates for cordage for telecommunications applications is typically carefully selected and strictly maintained within the cordage to limit such near-end crosstalk.

Prior art patch plugs have a volume within which the twisted pairs and ultimately the individual wires are distributed from a multi-wire cable to the IDCs of a 110-type patch plug and a contact base. Lack of control over twist rates within the volume may lead to near-end crosstalk. Moreover, lack of control over routing paths within the volume may result in the levels of such crosstalk varying significantly from one patch plug/cordage assembly to another, due to variations in those routing paths from assembly to assembly. The resulting electrical/transmission performance variability may be intolerable for certain high-performance, high-speed telecommunications systems. There have been, and are, numerous arrangements for alleviating the crosstalk problem, the examples of which are shown in the aforementioned Baker et al. patents and in the Lin application. These arrangements are directed primarily to the reduction of NEXT where the connector is used to terminate cordage having two or more twisted pairs, and, for the most part, feature wire guide channels through which different twisted pairs are routed to, for example, the insulation displacement contacts (IDCs) of the connector. It has been found that closer management of the routing of the individual twisted pairs, both at the transition from the cable to the wire guide troughs and within the connector between the transition and the IDCs than is currently available, is needed to reduce near end crosstalk (NEXT) even further.

SUMMARY OF THE INVENTION

The present invention is an improved plug of the 110-type patch plug of the VISIPATCH® type for interconnecting at least four twisted pairs of wires in a cordage or cable that is designed to reduce NEXT among the pairs of wires by means of an improved wire management scheme. In a VISIPATCH® plug, the connector ends of the contact blades in the contact base face toward the cable entrance end of the plug.

In greater detail, the plug of the invention comprises a substantially hollow wire guide body portion having an input end for receiving the twisted pairs of wires in the cable and an output end having a contact base having IDCs for receiving each of the several wires of the twisted pairs in a standard horizontal array. An insert member comprises a crosstail, one end of which is insertable into the cable jacket for segregating each twisted pair in a discrete walled channel. The insert has a substantially fan shape within the body of the plug and upper and lower pair guide portions. The upper guide portion has first and second substantially parallel channels defined by the crosstail, which are separated by a wall portion and which function as separated guides for first and second twisted pairs. The insert has an output end which, when the insert is positioned in the plug body, is immediately adjacent to the IDCs at the output end thereof. Thus the first and second twisted pairs are constrained and separated from each other from within the cable jacket to their connection to the IDCs and their twist rates are maintained throughout. The lower guide portion has third and fourth channels which are defined by the crosstail but which, following the fan like shape of the insert, fan out away from each other to create a large horizontal separation from each other leading to the IDCs. Thus, the third and fourth twisted pairs are separated from each other horizontally and from the first and second pairs both horizontally and vertically. Each of the channels at the output end has a necked down portion which serves to maintain the two wires of the twisted pairs within the channel in a vertical (one on top of the other) orientation. This helps to prevent any bellying, untwisting, or separation of the wires of the pair. A cap member for the housing fits thereover, enclosing the insert within the housing and holding it in place. A crimpable metallic ring functions as a strain relief member. The ring is fitted over the cable jacket portion that surrounds the crosstail and, when crimped, affixes that portion of the cable jacket to the crosstail and, hence, the insert. This arrangement prevents movement of the plug relative to the cable when subjected to externally applied forces, such as, most often, tension, thereby supplying strain relief.

The plug of the invention manages each twisted pair over the complete distance from within the cable to the IDCs, maintaining their pair twists and creates and maintains both vertical and horizontal separation among the several pairs to minimize crosstalk.

DESCRIPTION OF THE DRAWINGS

FIG. 5 is a front elevation view of the wire guide body portion of FIG. 3;

FIG. 6 is a front elevation view of the contact base of the plug of the invention, showing its relationship to the wire guide body portion of FIGS. 3, 4, and 5;

FIG. 7 is a plan view of the contact base;

FIG. 8 is a rear elevation view of the contact base:

FIG. 9 is a side elevation view of the contact base;

FIG. 10(*a*) is a detail of the insert of FIG. 10 along the line I—I of FIG. 10;

DETAILED DESCRIPTION

Figure 1:
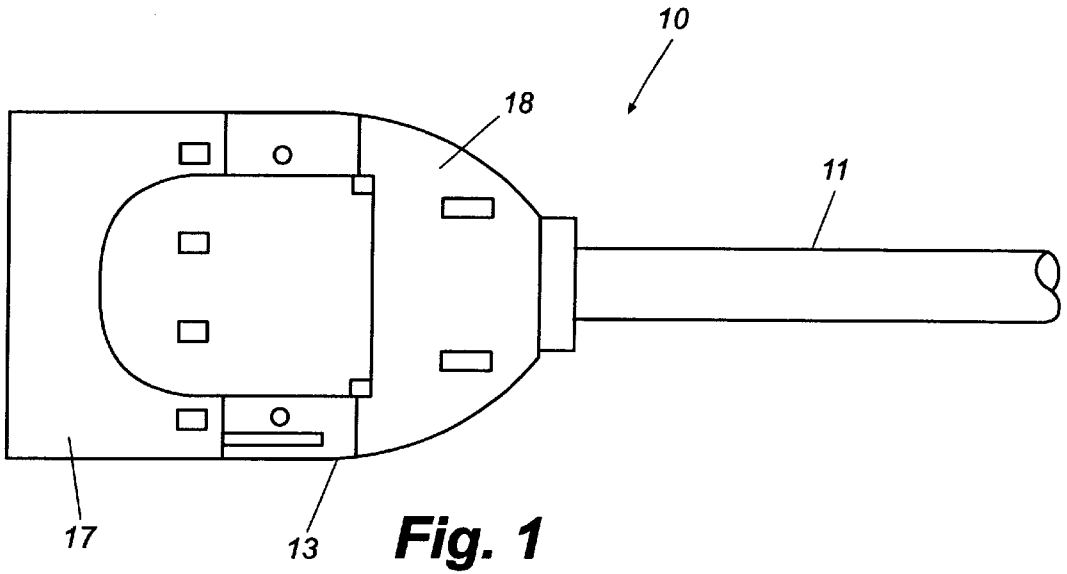
FIG. 1 is a plan view of the plug of the invention.
Figure 2:
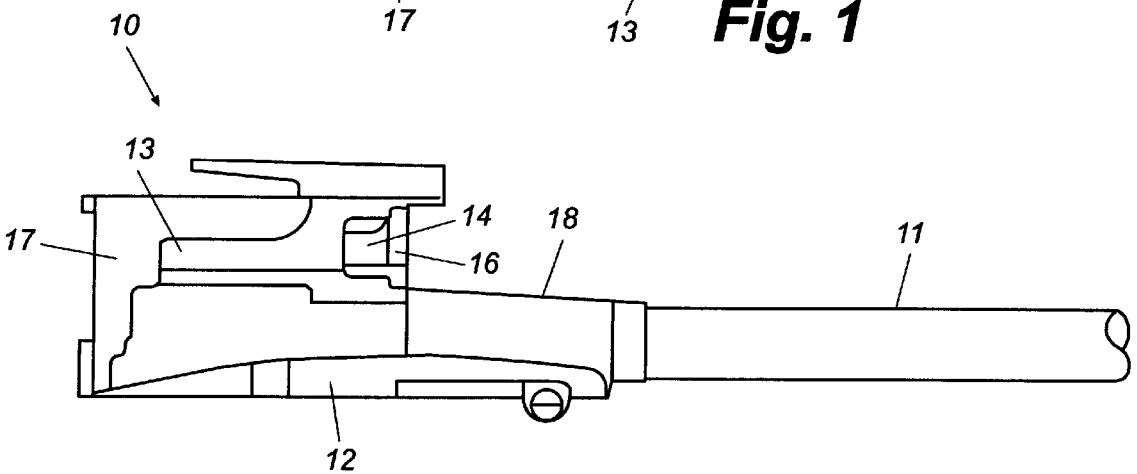
FIG. 2 is a side elevation view of the plug of the invention.

The connector plug 10 of the invention is shown in FIGS. 1 and 2 as fully assembled.

Plug 10 functions as a termination for a cable 11 which, for purposes of illustration, contains four twisted pairs of wires (not shown in FIGS. 1 and 2). Plug 10 comprises a wire guide body portion 12, a contact base member 13 having a plurality of contact blades 14 and 16 therein, as will be seen more clearly hereinafter, a top cover 17 and an anti-snag cover 18.

Figure 3:
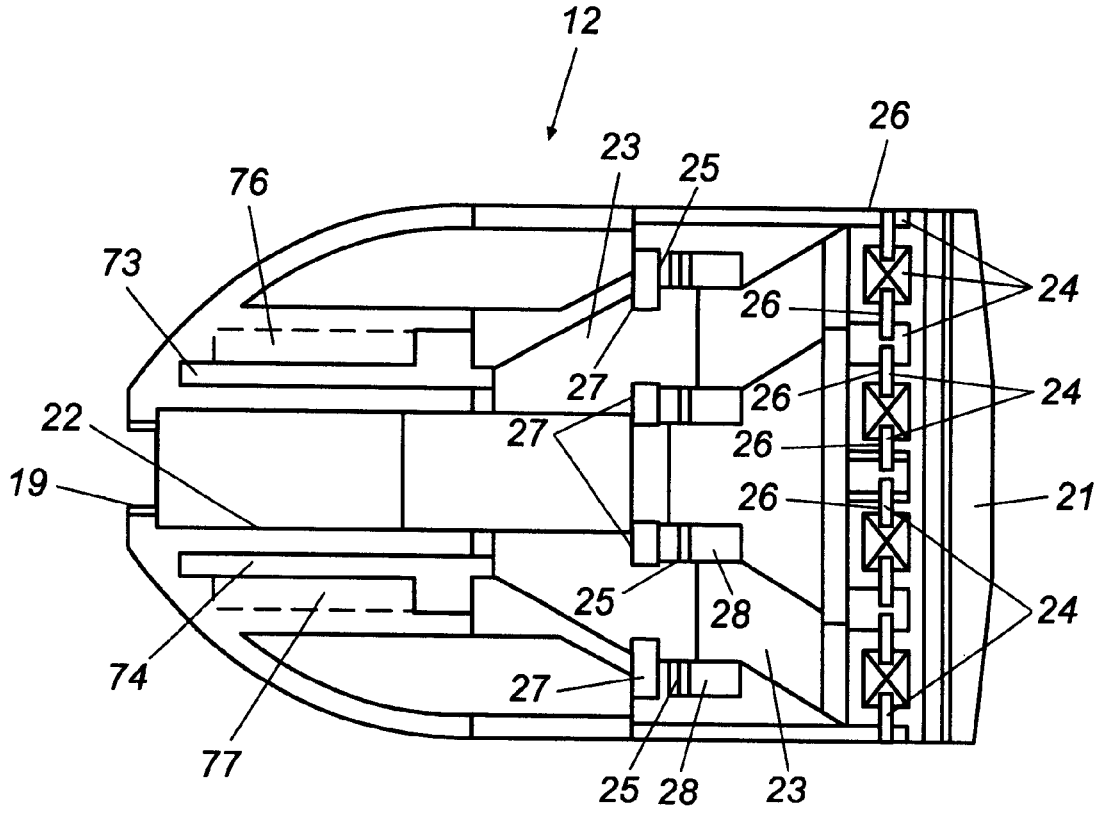
FIG. 3 is a plan view of the wire guide body portion of the plug of the invention.
Figure 4:
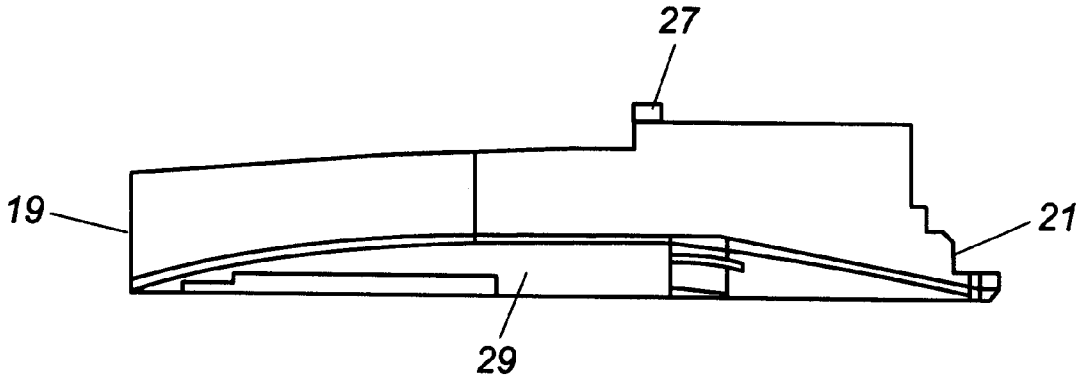
FIG. 4 is a side elevation view of the body portion of FIG. 3.

Wire guide body portion 12 as shown in FIGS. 3, 4, and 5 comprises a cable entrance end 19 and a contact end 21 adapted to receive a contact base member 13 . A channel 22 functions as a guide for the cable 11. Between the end of channel 22 and contact base member receiving end 21 is a fan shaped recessed portion 23, which ends in an array of posts 24 which form IDC receiving slots 26 for the IDCs on the contact base member 13, as best seen in FIGS. 5 and 6. Within the fan shaped portion 23 is a plurality of latching posts 27 having openings 28 at their bases and latching projections 25 thereon, the function of which will be fully explained hereinafter. The fan shaped portion 23 partially defines wire guiding channels for guiding wire pairs to the outermost receive slots 26. The bottom surface 29 of member 12 has a curved profile, as shown.

Figure 19A:
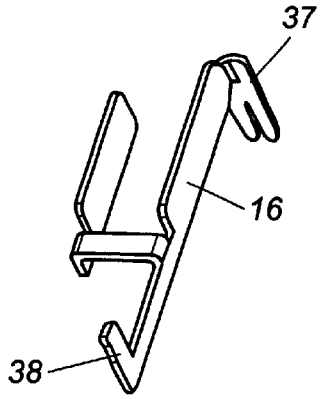
FIG. 19(*a*) and 19(*b*) are perspective views of the contact blades of the plug of the invention.
Figure 19B:
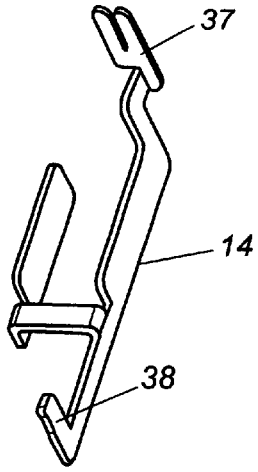

FIGS. 6 through 9 depict the contact base member 13 and its orientation relative to wire guide body portion is shown in FIG. 6. Member 13 comprises a block 31 having an IDC end 32 and a blade contact end 33 and which is grooved to receive an array of a plurality of upper and lower contact blades 14 and 16, each having an IDC 37 at one end thereof and a blade contact 38 at the other end. The configuration of the blades 14 and 16 is shown in FIGS. 19(*a*) and l9(*b*), and will be described in the discussion of those figures. As will be described more fully hereinafter, and with reference to FIG. 2, when contact base member 13 is in position on member 12, the blade contacts 38 face to the rear of plug 10. This is a feature of the VISIPATCH® connector which makes it possible to plug the member 10 onto a patch panel with the cable being located out of sight behind the panel. This feature eliminates the confusion which is a consequence of having a tangle of cables at the front of the panel.

Block portion 31 has a plurality of rectangular bores 35 therein which, when member 13 is mounted on wire guide body portion 12, align with the openings 28 therein.

Figure 11:
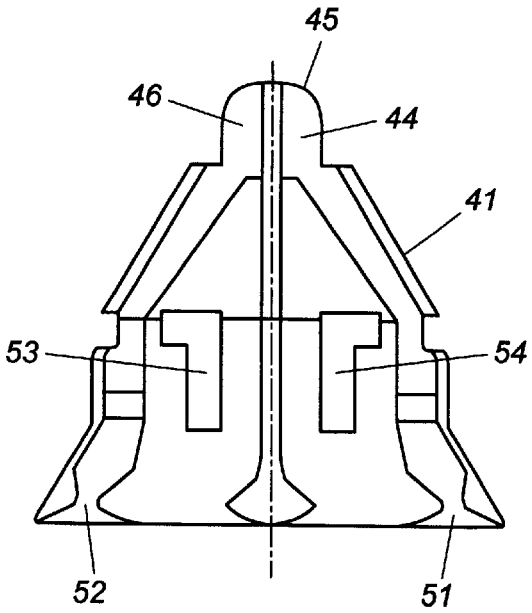
FIG. 11 is a plan view of the bottom surface of the insert of FIG. 10.
Figure 12:
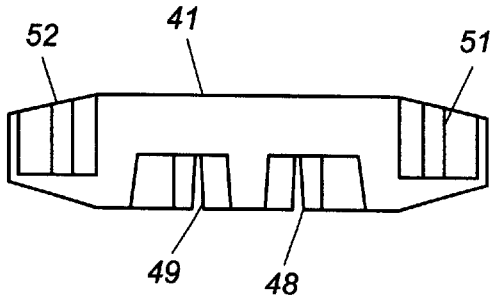
FIG. 12 is a front elevation view of the insert of FIGS. 10 and 11.
Figure 10:
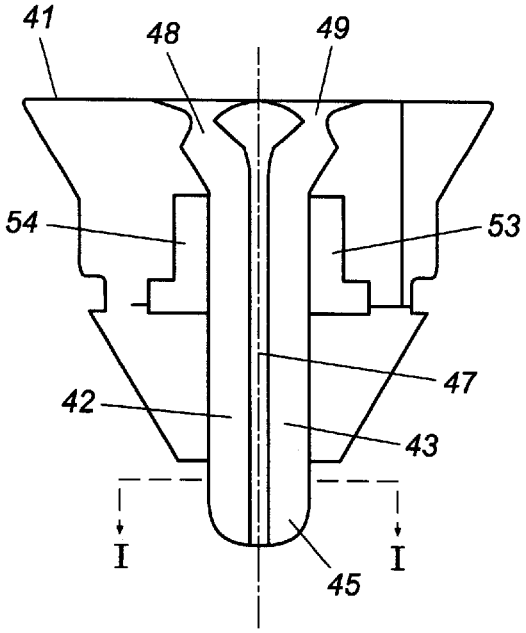
FIG. 10 is a plan view of the top surface of the wire guide insert of the invention.
Figure 10A:
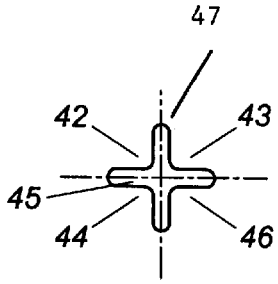

In accordance with the present invention and as shown in FIGS. 10 through 12, an insert member 41 having a fan shape corresponding to the fan shape of the recess 23 in member 12 is insertable in member 12. Member 41 has a cross-tail 45 defining four channels 42, 43, 44, and 46 which is insertable in the end of cable 11 and each of its four twisted pairs therein is laid in one of the channels 42, 43, 44 and 46. The broad end of insert 41 when the insert 41 is positioned in recess 23 is immediately adjacent the array of posts 24 in member 12 and the slots 26 formed thereby which receive the IDCs of contact base member 13. Channels 42 and 43, separated by wall 47 extending from the cross-tail 45 to the broad end of insert 41, 42, and 41 substantially align with two adjacent slots in the end of member 12. The two wires of the wire pair in each channel 42 and 43 are held in vertical position (one wire on top of the other) by constrictions 48 and 49 at the flared ends of channel 42 and 43. As will be apparent hereinafter more particularly from FIG. 17, the wires are positions in a corresponding slot for contact to be made with the IDCs 37 when member 13 is mounted in place, as shown in FIGS. 5 and 6. Thus the two twisted pairs of wires, one pair in each of channels 42 and 43 maintain their twisted configuration throughout the length of plug 10 with a consequent prevention of increased crosstalk therebetween and substantially no separation of the wires of each pair.

Figure 18:
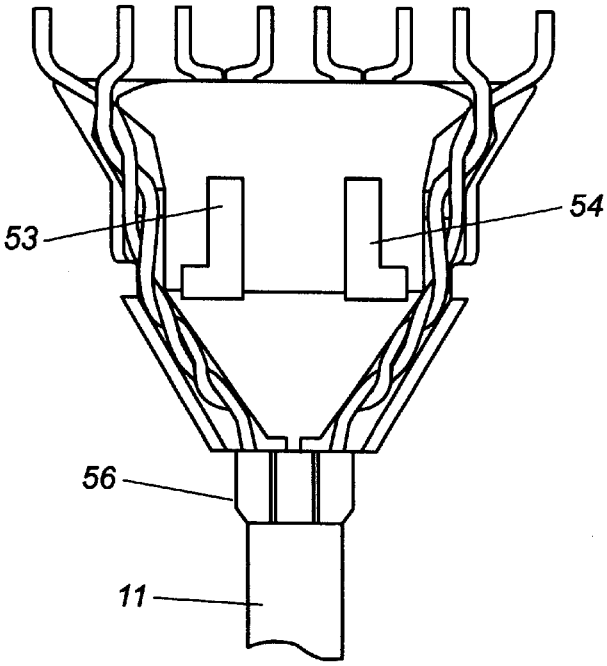
FIG. 18 depicts the wire guide action of the bottom surface of the insert.

In FIG. 11, the underside of insert member 41 is shown. It is to be understood that all terms such as "top", "bottom", "upper", "lower", "front" and "rear" and the like refer to orientations as shown in the drawings, and not necessarily to orientation in use. In FIG. 11 it can be seen that cross-tail 45 forms two lower channels 44 and 46, which, within the insert 41 fan out, conforming to the fan-like shape of the insert. The channels 44 and 46, like channels 42 and 43 have constrictions 51 and 52 therein so that the wires in each wire pair, one pair in each of channels 44 and 46, are held in place, one over or above the other. Channels 44 and 46, also like channels 42 and 43, each ends immediately adjacent to IDC receiving slots 26 so that the twisted wires can be contacted by IDCs 37 in member 13. The configuration of insert member 41 is such that the "underside" thereof shown in FIG. 11 may become the top side of the insert and the top side shown in FIG. 10, may be made the "underside" by simply flipping insert member 41 over. The arrangement of the wires in insert 41 is best seen in FIG. 18. When the wire pairs have been placed in their assigned channels 42, 43, 44, and 46 and their ends into slots 26, contact base member 13 is mounted in place, with IDCs 37 making contact with individual wires in slots 26. The pairs of wires are maintained in separated or spaced relationship throughout the length of the connector 10, and, in addition, the two outermost pairs are not only widely separated from each other horizontally, but are also vertically separated from the other two pairs of wires as well. Such management of the wires, from cable entrance end 19 to the IDC contact end has been found to produce excellent cross-talk control a well as consistency from plug to plug. Insert 41 has two L-shaped openings 53 and 54, one on each side of the channels 42, 43, 44, and 46. The foot of each L-shape fits over one of two adjacent posts 27, and the leg of the L-shape is an opening that aligns with the openings 28 at the foot of each of the two posts.

Figure 13:
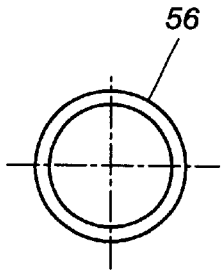
FIG. 13 is an elevation view of the crimping ring of the invention.
Figure 14:
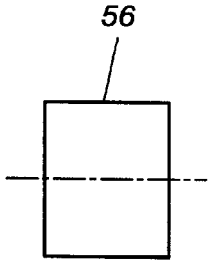
FIG. 14 is a side elevation view of the crimping ring.
Figure 15:
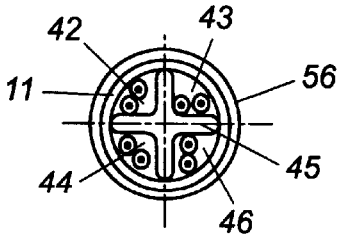
FIG. 15 is a detailed view showing the crimping ring of FIGS. 13 and 14 in position about the cable jacket and the cross-tail of the insert of FIGS. 10 and 10(*a*)

FIGS. 13, 14, and 15 depict a crimping ring 56 made of suitable material which surrounds the jacket of cable 11. When cross tail 45 is inserted into cable 11, ring 56 is crimped to hold the cable 11 firmly against cross-tail 45, as best seen in FIG. 15. Thus relative movement between the cable 11 and the plug 10 is prevented, providing strain relief for the cable/plug combination.

Figure 16:
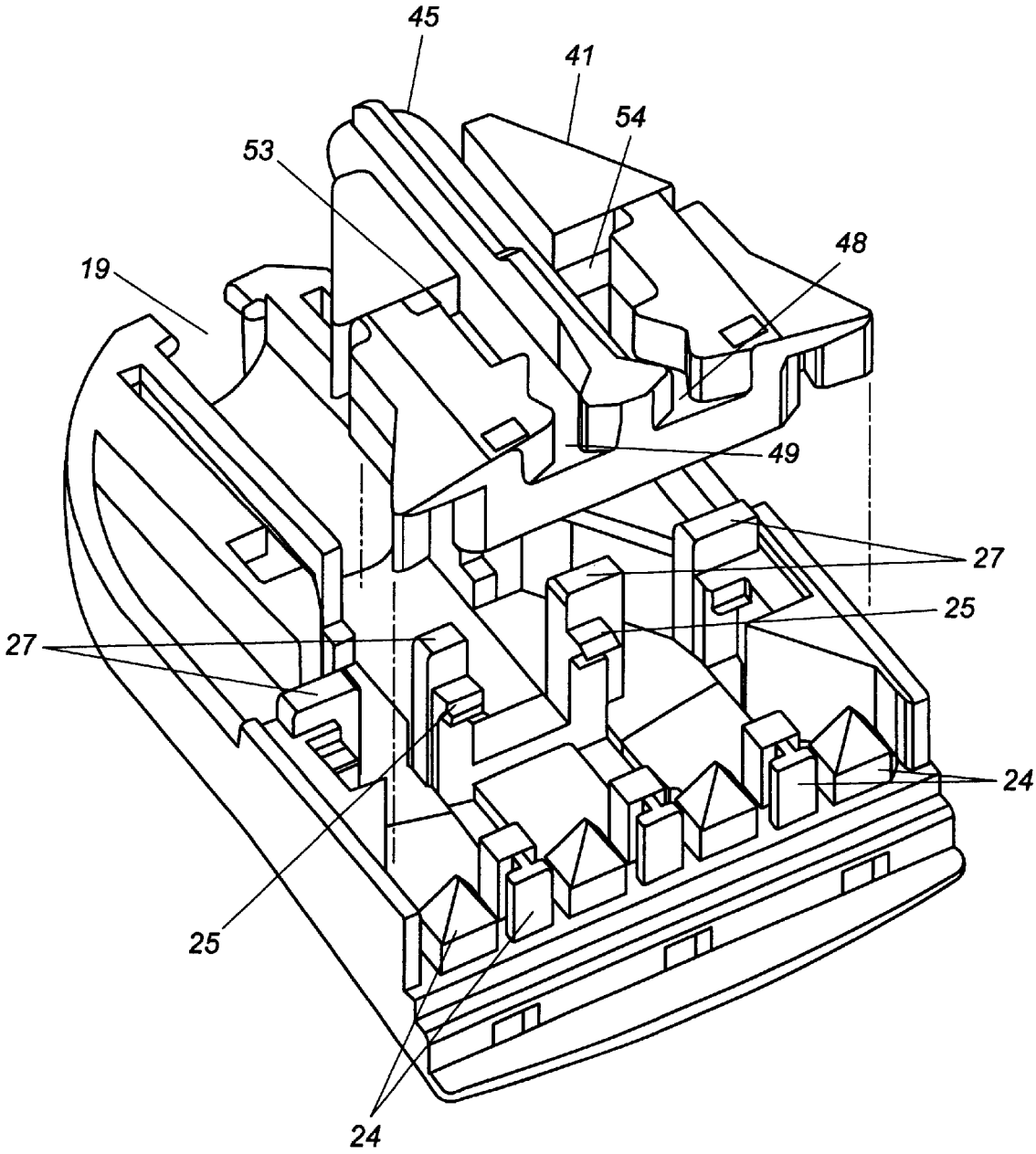
FIG. 16 is an exploded perspective view of the insert and the wire guide base in relation to each other.
Figure 17:
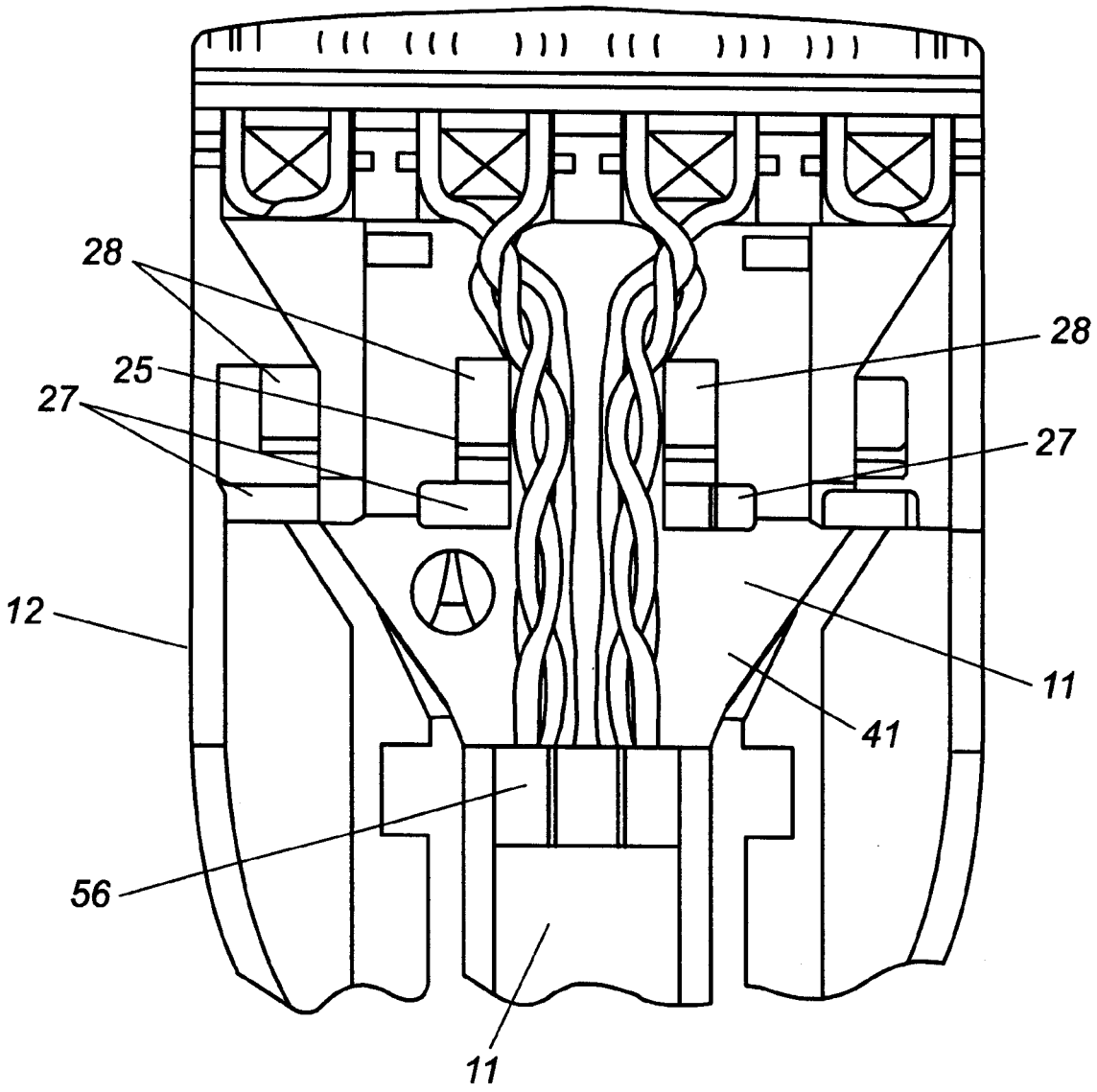
FIG. 17 depicts the wire guiding action of the top surface of the insert.

FIG. 16 depicts the relationship of wire guide body portion 12 and insert member 41, and FIGS. 17 and 18 depict, respectively, the twisted pair management for the upper side of insert 41 and for the lower side thereof. As best seen in FIG. 17, the wires of each twisted pair remain twisted from within the cable 11 through the plug 10 to the IDC receiving slots 26. Such wire management produces consistent results in the wiring and use of each plug.

Figure 20:
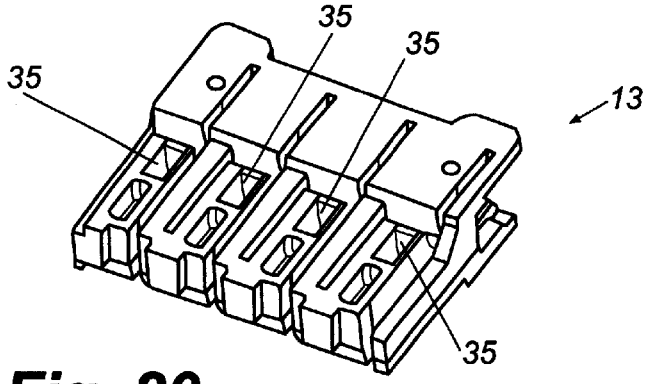
FIG. 20 is a perspective view of the contact base of the plug of the invention.

FIGS. 19(*a*) and 19(*b*) depict the lower and the upper blade contacts 16 and 14 respectively and FIG. 20 is a perspective view of contact base 13 as grooved to receive the blades 14 and 16. The grooving for the underside of base 13 is virtually identical to the upper surface grooves shown, with the lower grooves offset approximately one IDC width from the upper groves.

Figure 21:
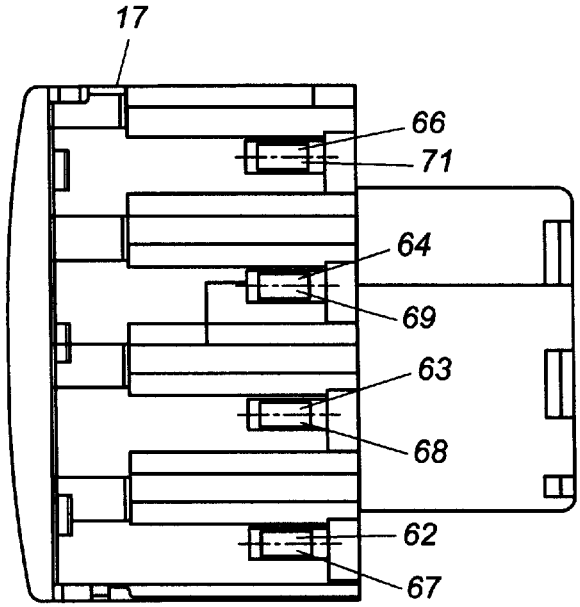
FIG. 21 is a plan view of the top cover for the plug of the invention.
Figure 22:
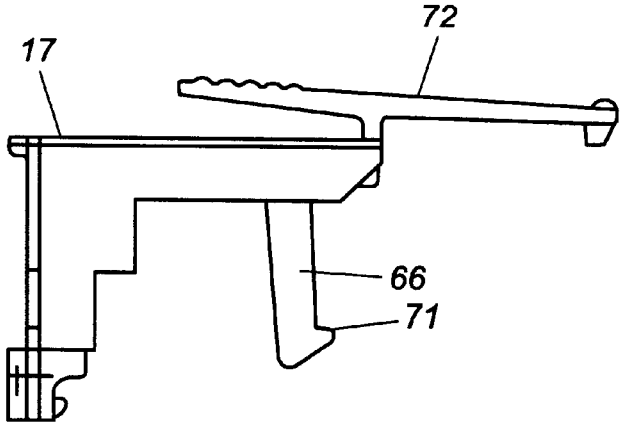
FIG. 22 is a side elevation view of the top cover of FIG. 21.
Figure 23:
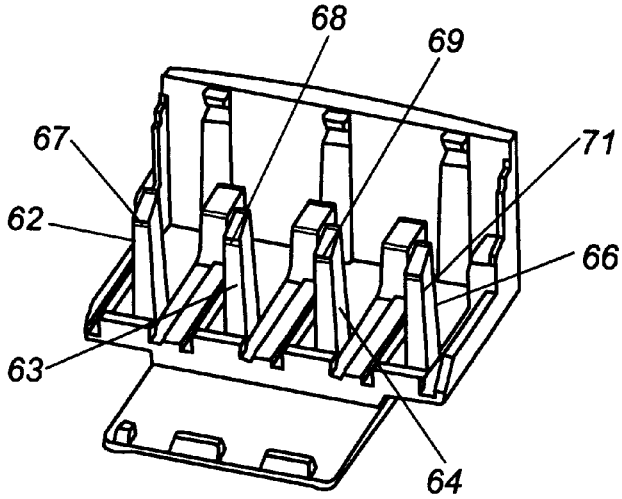
FIG. 23 is a perspective view of the top cover of FIGS. 21 and 22.

FIGS. 21, 22, and 23 depict a cover member 17 which is designed to fit over contact base 13. Depending from the underside of cover 17 are four spaced latching arms 62, 63, 64, and 66, each of which has a latching projection 67, 68, 69, and 71 respectively. When cover 17 is fitted in place over the plug, the arms 62, 63, 64, and 66 pass through the openings 35 in member 13, and openings 53 and 54 in insert 41 and latch to the projections 25 on posts 27 of the wire guide base member 12. Thus, members 12, 41, 13, and 17 are locked together. Cover 17 has mounted thereon a finger board 72 for facilitating gripping of the plug 10 when it is being inserted or withdrawn from the patch panel.

Figure 24:
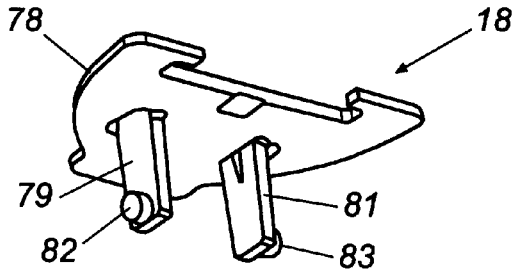
FIG. 24 is a perspective view of the anti-snag cover for the plug of the invention.

Wire guide body portion has, on either side of channel 22 L-shaped slots 73 and 74 in the top surface thereof which form, with slots 76 and 77 on the bottom surface, retaining channels for an anti-snag cover 18 shown in FIG. 24. As can be seen in FIG. 24, cover 18 comprises a flat plate 78 having depending from its bottom surface first and second legs 79 and 81, each having, on its distal end, a boss 82 or 83. Prior to the mounting of connector base 13 on member 12, the bosses 82 and 83 are inserted into the retaining channels through the foot of each L-shaped slot 73 and 74, and are free to move within the retaining channels. When member 13 has been mounted on member 12, cover 18 is prevented from moving forward to where the bosses encounter the feet of L-shaped slots so that the cover 18, while still moveable in the retaining slots, is retained therein and cannot be removed. As shown in FIGS. 1 and 2, the anti-snag cover 18 covers the cable entrance end region of the connector 10 and effectively prevents accidental snagging thereof with external devices.

It is to be understood that the various features of the present invention might be incorporated into other types of connectors, and that other modifications or adaptations of the principles and features herein illustrated might occur to workers in the art. All such variations, modifications, or adaptations are intended to be included herein as being within the scope of the invention as set forth. Further, in the claims hereafter, the corresponding structures, materials, acts and equivalents of all means or step-plus-function elements are intended to include any structure, materials, or acts for performing the functions in combination with other elements as specifically set forth in the claims.

What is claimed is:

1. A connector for cordage having one or more twisted wire pairs, said connector comprising:

a body portion having a cable entrance end, a contact end, and a recess therein between said ends;

said contact end having a linear array of contacts across the width thereof with at least two contacts at each end of the array and at least four or more contacts intermediate the ends of the array;

said recess having a flared portion for guiding wire pairs to said contacts at the ends of the array;

an insert member in said recess and extending from said cable entrance end to said contact end immediately adjacent thereto and having a flared shape to conform the flared portion of said recess, said insert member having a top surface and a bottom surface;

one of said surfaces of said insert having first and second substantially parallel wire guide channels separated by a wall portion for guiding first and second wire pairs from said cable entrance end to said contacts intermediate the ends of the array; and the other of said surfaces having third and fourth wire guide channels which conform to the flared shape of said insert for guiding third and fourth wire pairs from said entrance end to said contacts at the ends of the array.

2. A connector as claimed in claim 1 wherein said one of said surfaces is said top surface.

3. A connector as claimed in claim 1 wherein said one of said surfaces is said bottom surface.

4. A connector as claimed in claim 1 wherein said insert member has one end thereof adjacent said cable entrance end having a cross-tail for insertion into the end of the cable, said cross-tail defining said first, second, third, and fourth channels.

5. A connector as claimed in claim 4 wherein said first and second channels defined by the cross-tail are directed to said top surface and said third and fourth channels are directed to said bottom surface.

6. A connector as claimed in claim 4 and further comprising a crimping ring for surrounding that portion of the jacket of the cable in which said cross-tail is located.

7. A connector as claimed in claim 1 wherein said body portion has, at the contact end, an array of slots for receiving a plurality of contacts, said contacts being mounted on a contact base member and insertable in said slots.

8. A connector as claimed in claim 7 wherein said body portion has an array of a plurality of latching posts having latching projections thereon extending upward from said body portion.

9. A connector as claimed in claim 8 wherein said contact base member has an array of a plurality of openings therein through which said latching posts pass when said contacts are fully inserted in said slots.

10. A connector as claimed in claim 9 and further comprising a cover member having an array of a plurality of latching arms depending from the underside thereof, said latching arms having latching projections thereon and being spaced to pass through said openings in said contact base to latch with said latching posts on said body portion to hold said body portion, said insert, said contact base, and said cover member firmly together.

11. A connector as claimed in claim 10 and further comprising an anti-snag cover movably mounted on said body portion.

* * * * *